US008167154B2

(12) United States Patent
Heidrich et al.

(10) Patent No.: US 8,167,154 B2
(45) Date of Patent: May 1, 2012

(54) ELECTROHYDRAULIC LEAK COMPENSATION

(75) Inventors: Thomas Heidrich, Wilhelmshaven (DE); Johannes Schuerman, Jever (DE)

(73) Assignee: Manitowoc Crane Group France SAS, Ecully (FR)

( * ) Notice: Subject to any disclaimer, the term of this patent is extended or adjusted under 35 U.S.C. 154(b) by 391 days.

(21) Appl. No.: 12/468,538

(22) Filed: May 19, 2009

(65) Prior Publication Data

US 2009/0294746 A1 Dec. 3, 2009

(30) Foreign Application Priority Data

May 21, 2008 (DE) ..... 10 2008 024 512

(51) Int. Cl.
*B66C 13/12* (2006.01)

(52) U.S. Cl. ..... 212/289; 212/284

(58) Field of Classification Search ..... 212/284, 212/287, 288, 289
See application file for complete search history.

(56) References Cited

U.S. PATENT DOCUMENTS

| | | | | |
|---|---|---|---|---|
| 4,187,681 | A | 2/1980 | Johnson | |
| 4,549,640 | A | 10/1985 | Sekino | |
| 5,806,838 | A | 9/1998 | Kalve et al. | |
| 6,012,707 | A | 1/2000 | Enlund | |
| 6,079,576 | A | 6/2000 | Bosler et al. | |
| 7,386,978 | B2 * | 6/2008 | Ivantysynova et al. | 60/434 |
| 2004/0232398 | A1 | 11/2004 | Mert et al. | |
| 2007/0227133 | A1 * | 10/2007 | Aarestad et al. | 60/413 |

FOREIGN PATENT DOCUMENTS

| | | | |
|---|---|---|---|
| CN | 01413900 | | 10/2001 |
| DE | 4419199 | C1 | 1/1996 |
| DE | 19604428 | C2 | 6/1998 |
| DE | 19913277 | A1 | 9/2000 |
| EP | 1475347 | B1 | 10/2007 |
| JP | 8-217389 | | 8/1996 |
| JP | 08217389 | | 8/1996 |
| JP | 9-48594 | A | 2/1997 |
| JP | 11005693 | | 1/1999 |
| JP | 11-246181 | A | 4/1999 |
| JP | 2003-322103 | A | 11/2003 |
| JP | 2003322103 | | 11/2003 |
| WO | 2006008052 | A1 | 1/2006 |

* cited by examiner

*Primary Examiner* — Emmanuel M Marcelo
(74) *Attorney, Agent, or Firm* — Brinks Hofer Gilson & Lione; Steven P. Shurtz

(57) ABSTRACT

The invention relates to an electro-hydraulic leak compensating device for a mobile crane lowering brake system in an open hydraulic circuit with a hydraulic motor (5) coupled with a lifting unit (6,7), a lowering brake valve (4) and a mechanical brake (9), with a pressure sensor (13) which measures the hydraulic pressure prevailing on the load side of the hydraulic motor (5) in the hydraulic circuit and on the side of the lifting conduit (3) before the mechanical brake (9) is closed, in particular immediately before it is closed, as well as a method of electro-hydraulically compensating for leaks of a mobile crane lowering brake system in an open hydraulic circuit with a hydraulic motor (5) coupled with a lifting unit (6,7), a lowering brake valve (4) and a mechanical brake (9), comprising the following method steps:

measuring the hydraulic actual pressure prevailing on the load side of the hydraulic motor (5) before the mechanical brake (9) is closed, in particular immediately before it is closed;

determining a desired pressure by setting off the measured actual pressure against a previously determined value depending on the load state;

generating the desired pressure in the volume (12) before the mechanical brake (9) is opened.

23 Claims, 1 Drawing Sheet

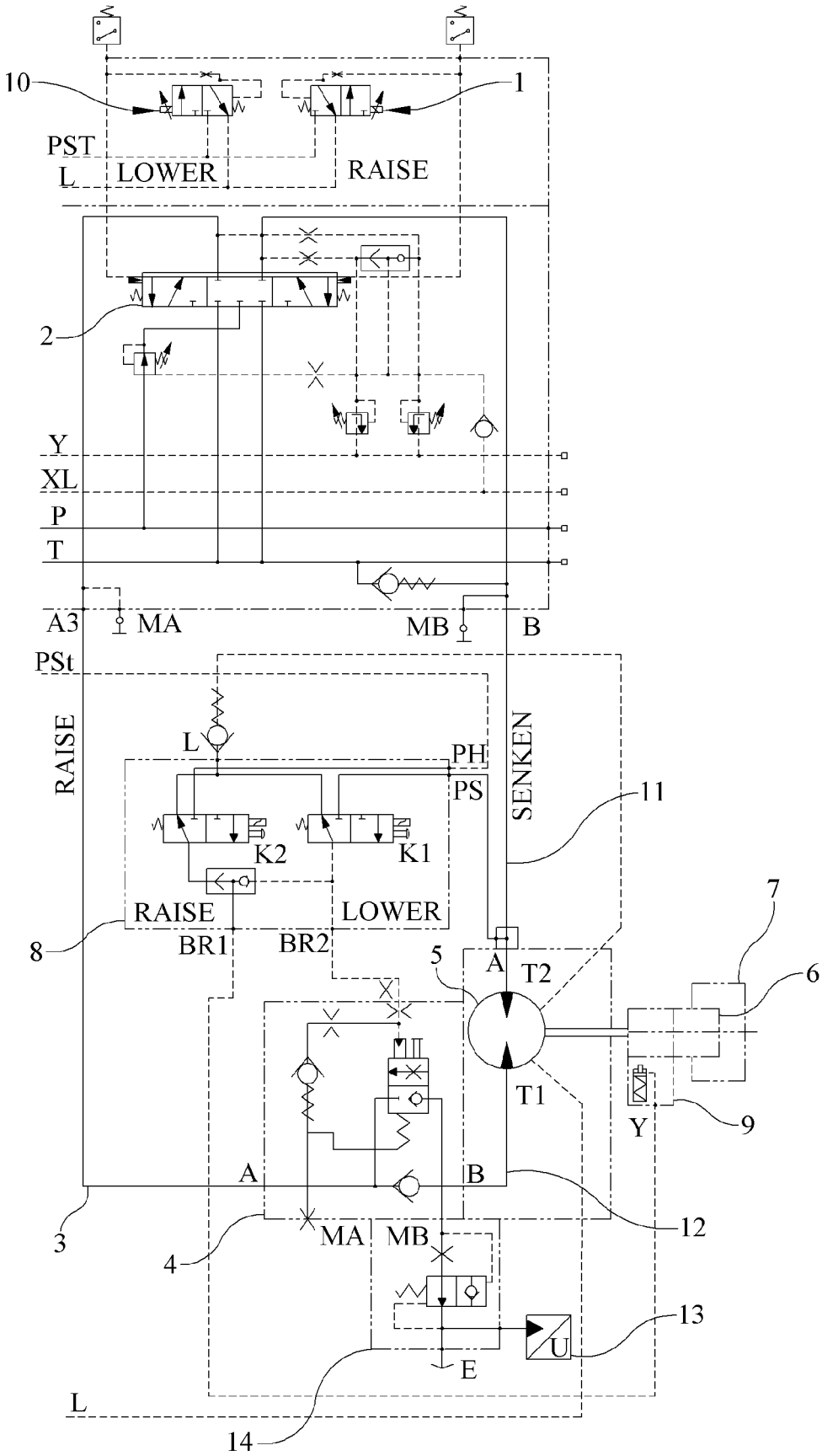
10
1
PST
L
LOWER
RAISE
2
Y
XL
P
T
A3
MA
MB
B
PSt
RAISE
L
PH
PS
SENKEN
11
K2
K1
RAISE
LOWER
8
BR1
BR2
5
A
T2
7
6
T1
Y
9
A
B
3
4
MA
MB
12
13
U
E
L
14

ELECTROHYDRAULIC LEAK COMPENSATION

CROSS REFERENCE TO PRIOR APPLICATION

This application is a Paris Convention Filing under 35 U.S.C. §119 and claims priority to and benefit from German Application DE 10 2008 024 512.7-22, filed on May 21, 2008.

FIELD OF THE INVENTION

The invention relates to an electro-hydraulic leak compensating device for a mobile crane lowering brake system in an open hydraulic circuit and also to a method of electro-hydraulically compensating leaks in a mobile crane lowering brake system in an open hydraulic circuit. Both the method and the device can be used for a mobile crane with one or with several hoists connected into the open hydraulic circuit, in which the suspended load is secured by means of a lowering brake valve and a mechanical brake to prevent the load from falling.

Mobile cranes with one or more lifting units operated in an open hydraulic circuit are known from the prior art. The lifted load is retained by means of a lowering brake valve on the hydraulic motor in conjunction with a mechanical brake.

Modern mobile cranes are used for lifting increasingly higher loads, for which purpose the demand for sensitive activation of the hoists on behalf of the client is increased at the same time. Internal leakages in the hydraulic motor intrinsic to the system have a detrimental effect when it comes to accurate lifting and lowering of the load to within a millimeter.

An oil volume is disposed between the lowering brake valve and the lifting unit motor, which is placed under pressure when the mechanical brake is opened and retains the load suspended on the lifting unit. When the mechanical brake is closed, this load pressure is reduced due to internal leakage of the hydraulic motor. When the mechanical brake is opened again, a specific quantity of oil which has escaped in the meantime has disappeared. This being the case, the load pressure does not build up again until the hoist and the hydraulic motor have been rotated backwards by a minimum amount. This leads to initial jolting of the lifting unit as the load is lifted and lowered. The jolt causes a perceptible detrimental effect, especially in the case of hoists with big hydraulic motors.

Every hydraulic motor exhibits wear due to aging, which becomes apparent during its service life due to an increase in internal leakages. This causes additional detrimental effects on start-up behaviour.

Patent specification DE 196 04 428 C2 discloses a control device for a lifting gear of a crane which enables a load to be retained, lifted or lowered without jolting by compensating the oil pressure in the hydraulic circuit with the torque of the lifting gear drum. To this end, a pressure sensor is disposed between a hydraulic pump and a hydraulic motor in a closed hydraulic circuit and a torque sensor is provided on the lifting gear drum. During operation of the crane, the parking brake is not released again until the pressure sensor measures a pressure which corresponds to the retaining torque of the lifting gear drum depending on the current load state.

The objective of this invention is to propose a leak compensating device for a mobile crane lowering brake system in an open hydraulic circuit with one or more lifting units, thereby resulting in a mobile crane which exhibits better start-up behaviour of the lifting units than known systems.

This objective is achieved by means of an electro-hydraulic leak compensating device and by means of a method of electro-hydraulically compensating for leaks.

As proposed by the invention, the electro-hydraulic leak compensating device comprises a pressure sensor, which measures the hydraulic pressure on the load side of the hydraulic motor before the mechanical brake is closed. This being the case, the hydraulic pressure or load pressure immediately before closing the mechanical brake is known, thereby making it possible to build back up to this measured pressure value before the mechanical brake is opened so that the lifting unit can be started without jolting. The load side of the hydraulic motor is the side of the hydraulic circuit in which the lifting conduit for the hydraulic motor is disposed.

BRIEF DESCRIPTION OF THE DRAWING

FIG. 1 shows an schematic view of a hydraulic circuit for a portion of a mobile crane. The schematic consists of the following:

| | |
|---|---|
| 1 | Lift servo valve |
| 2 | Slide valve |
| 3 | Lifting conduit |
| 4 | Hydraulic lowering brake valve |
| 5 | Hydraulic motor |
| 6 | Gear |
| 7 | Lifting unit drum |
| 8 | Brake air valve |
| 9 | Mechanical brake |
| 10 | Lower servo valve |
| 11 | Lowering conduit |
| 12 | Oil volume |
| 13 | Pressure sensor |
| 14 | Automatic shut-off valve |

DETAILED DESCRIPTION OF THE INVENTION

In a preferred embodiment, a control unit stores the measured pressure as an actual pressure. This measured actual pressure corresponding to the load situation is used as a reference for the pressure which has to be built back up again shortly before the mechanical brake is opened in order to start up the lifting unit without jolting. To this end, hydraulic fluid is introduced into a volume between the hydraulic motor and the lowering brake valve in order to compensate for a quantity of fluid which escapes from the volume due to leakage during the time the mechanical brake is closed.

Before the mechanical brake is opened, a pump of the mobile crane preferably transfers fluid from the lifting conduit to the volume between the hydraulic motor and lowering brake valve until the desired quantity of fluid has been delivered and the desired pressure level has been reached in the volume.

The level of pressure built up may correspond to the value of the pressure which prevailed before the mechanical brake was closed, although it may also be different from it, in other words higher or lower than the pressure measured prior to closing the mechanical brake.

The lifting unit may also have a gear, in which case the hydraulic motor is ultimately coupled with the lifting unit drum via the gear and mechanical brake.

In another preferred embodiment, the lowering brake valve in the hydraulic circuit is disposed on the load side of the hydraulic motor, in other words on the side on which the hydraulic motor driven by the pressure prevailing there runs to the lifting conduit.

It would also be conceivable for the pressure sensor to be disposed in the hydraulic circuit on the load side of the lowering brake valve, namely on the side of the lifting conduit running to the lowering brake valve. In other words, the lowering brake valve in this embodiment is disposed in the hydraulic circuit between the pressure sensor and hydraulic motor, although it would also be conceivable for the pressure sensor to be disposed between the lowering brake valve and hydraulic motor.

The invention further relates to a method of electro-hydraulically compensating for leakage of a mobile crane lowering brake system in an open hydraulic circuit.

As proposed by the invention, the pressure in the lifting conduit, in other words on the load side of the hydraulic motor, is measured by the pressure sensor before the mechanical brake is closed, preferably immediately before it is closed. This measured pressure may also be referred to as the actual pressure because it reflects the current load state on the lifting unit of the crane.

A desired pressure is then preferably set by a control unit by setting off the measured actual pressure against a previously determined value depending on the load state. This calculated desired pressure is then generated in the volume between the lowering brake valve and hydraulic motor immediately before the mechanical brake is opened so that the lifting unit can be started without jolting. In other words, the load pressure of the hoist is detected with the aid of a pressure sensor and optionally a factor applied to it by means of the control system and is then restored by delivering hydraulic oil to the volume between the lowering brake valve and hydraulic motor before every operation of opening the mechanical brake. This is done by activating the hoist in the lifting direction with the mechanical brake closed. Fluid is preferably removed from the lifting conduit and pumped into the volume between the lowering brake valve and hydraulic motor in order to build up the pressure before the mechanical brake is opened.

It is also preferable if all the method steps of the method proposed by the invention are run on a fully automated basis every time before lowering and raising a load, in other words without an operator having to intervene whilst running the method.

Another option is to detect the prevailing operating status before closing the mechanical brake, in particular immediately before closing it, so that a distinction is also made between raising and lowering a load. Making this distinction ultimately enables the control system to set off a value determined as a function of the load status against the measured actual pressure. It is perfectly conceivable for a pressure to prevail upstream of the hydraulic motor shortly before lifting a load which is higher than that prevailing when holding the same load because additional pressure has to be generated in order to accelerate the load. By detecting these load states, this invention makes it possible to ascertain the status when building up the pressure shortly before releasing the mechanical brake so that the lifting unit can be started without jolting even in such situations.

If different loads are being lifted, the load pressure can always be set immediately before closing the mechanical brake. In this respect, the control system is able to distinguish whether a load was previously lifted or lowered.

It would also be conceivable for the method proposed by the invention to be applied without exception during lifting and also during lowering and prior to lifting and also prior to lowering a load, although the method proposed by the invention could also be dispensed with in specific situations, especially if the load pressure or measured actual pressure drops below a previously set value.

Based on a preferred embodiment, it may be that when lifting the load, only the mechanical brake is opened but when lowering the load, both the mechanical brake and the lowering brake valve are opened in order to provide additional securing of the load.

The invention will be explained in more detail below on the basis of a preferred embodiment. It may incorporate all the features described here, both individually and in any practical combination. The single appended drawing, FIG. 1, is a circuit diagram of an electro-hydraulic leak compensating device proposed by the invention for a mobile crane lowering brake system with an open hydraulic circuit.

The servo valves for lifting 1 and lowering 10 operate the slide valve 2 and direct the hydraulic oil into the lifting conduit 3 or lowering conduit 11 respectively. The brake air valve 8 opens the mechanical brake 9 during lifting. During lowering, the mechanical brake 9 and lowering brake valve 4 are opened. The lifting unit is coupled via the gear 6 and mechanical brake with the hydraulic motor 5, on the load side of which the lowering brake valve 4 is disposed. The load pressure is determined by means of the pressure sensor 13 disposed on the load side of the lowering brake valve 4, where a bore provided with an automatic shut-off valve 14 serves as a connector.

As proposed by the invention, the lifting operation is run automatically in the sequence described below.

The servo valve 1 used for lifting opens the slide valve 2 in the lifting direction. Hydraulic oil is transferred via the lifting conduit 3 and lowering brake valve 4 to the hydraulic motor 5. Leakage of the hydraulic motor 5 between the lowering brake valve 4 and hydraulic motor 5 is compensated in the chamber 12 until the load pressure of the previous lifting or lowering operation is reached. By means of the brake air valve 8, the mechanical brake 9 disposed between the hydraulic motor and mechanical gear is opened. The hydraulic motor drives the lifting gear 7 via the mechanical gear 6.

The lowering operation based on the invention takes place automatically in the sequence described below.

The servo valve 1 used for lifting opens the slide valve 2 in the lifting direction. Hydraulic oil is transferred via the lifting conduit 3 and lowering brake valve 4 to the hydraulic motor 5. Leakage of the hydraulic motor 5 between the lowering brake valve 4 and hydraulic motor 5 is compensated in the chamber 12 until the load pressure of the previous lifting or lowering operation is reached. The servo valve 10 used for lowering opens the slide valve 2 in the lowering direction. Hydraulic oil is transferred via the lowering conduit 11 to the hydraulic motor 5. By means of the brake air valve 8, the mechanical brake 9 disposed between the hydraulic motor 5 and mechanical gear 6 is opened. At the same time, the lowering brake valve 4 is opened, depending on the desired lowering speed. The hydraulic motor 5 drives the lifting gear 7 via the mechanical gear 6.

The invention claimed is:

1. An electro-hydraulic leak compensating device for a mobile crane lowering brake system in an open hydraulic circuit with a hydraulic motor coupled with a lifting unit, a lowering brake valve and a mechanical brake, with a pressure sensor which measures the hydraulic pressure prevailing in the hydraulic circuit on the load side of the hydraulic motor before the mechanical brake is closed.

2. The leak compensating device as claimed in claim 1 wherein a control unit stores the measured pressure as an actual pressure and a pump of the mobile crane causes fluid to be delivered into a volume between the hydraulic motor and lowering brake valve before the mechanical brake is opened in order to compensate for the pressure loss which occurred in the volume during the time the mechanical brake was closed.

3. The leak compensating device as claimed in claim 1 wherein a pump of the mobile crane delivers fluid from a lifting conduit into the volume between the hydraulic motor and lowering brake valve in order to build up pressure before the mechanical brake is opened.

4. The leak compensating device as claimed in claim 3 wherein the pressure built up differs from the measured pressure depending on the load status.

5. The leak compensating device as claimed in claim 3 wherein the lowering brake valve in the hydraulic circuit is disposed on the load side of the hydraulic motor and on the lifting conduit side of the circuit.

6. The leak compensating device as claimed in claim 3 wherein the pressure sensor in the hydraulic circuit is disposed on the load side of the lowering brake valve and on the lifting conduit side of the circuit.

7. The leak compensating device as claimed in claim 1 wherein the hydraulic motor (5) is coupled with a lifting unit drum (7) via a gear (6) and the mechanical brake.

8. The leak compensating device as claimed in claim 1 wherein the pressure sensor measures the hydraulic pressure prevailing in the hydraulic circuit on the load side of the hydraulic motor between the hydraulic motor and the lowering brake valve.

9. The leak compensating device as claimed in claim 1 wherein the pressure sensor measures the hydraulic pressure prevailing in the hydraulic circuit immediately before the mechanical brake is closed.

10. The leak compensating device as claimed in claim 1 wherein a control unit stores the measured pressure as an actual pressure and a pump of the mobile crane causes fluid to be delivered into a volume between the hydraulic motor and lowering brake valve before the mechanical brake is opened in order to compensate for the pressure loss which occurred in the volume during the time the mechanical brake was closed on a fully automated basis.

11. A method of electro-hydraulically compensating for leaks in a mobile crane-lowering brake system in a open hydraulic circuit with a hydraulic motor coupled with a lifting unit, a lowering brake valve and a mechanical brake, comprising the following method steps: measuring the hydraulic actual pressure prevailing on the load side of the hydraulic motor before the mechanical brake is closed; determining a desired pressure by setting off the measured actual pressure against a previously determined value depending on the load state; and generating the desired pressure in the volume before the mechanical brake is opened.

12. The method as claimed in claim 11 wherein fluid is transferred from a lifting conduit into the volume in order to build up pressure before the mechanical brake is opened.

13. The method as claimed in claim 11 wherein the method steps are run on a fully automatic basis before a load is raised or lowered.

14. The method as claimed in claim 11 wherein the prevailing operating status is detected and in particular a distinction is made between lifting and lowering a load before the mechanical brake is closed.

15. The method as claimed in claim 11 wherein the method is applied both during/before lifting and during/before lowering a load.

16. The method as claimed in claim 11 wherein the method is not applied if the load pressure drops below a previously determined value.

17. The method as claimed in claim 11 wherein the mechanical brake is opened when lifting the load and the mechanical brake and the lowering brake valve are opened when lowering the load.

18. The method as claimed in claim 11 wherein the actual pressure is measured on the load side of the hydraulic motor and on a lifting conduit side of the hydraulic circuit.

19. The method as claimed in claim 11 wherein the actual pressure is measured on the load side of the lowering brake valve and on a lifting conduit side of the hydraulic circuit.

20. The method as claimed in claim 11 wherein the step of measuring the hydraulic actual pressure prevailing on the load side of the hydraulic motors before the mechanical brake is closed occurs immediately before the mechanical brake is closed.

21. The method as claimed in claim 11 wherein the prevailing operating status is detected and in particular a distinction is made between lifting and lowering a load immediately before the mechanical brake is closed.

22. The method as claimed in claim 11 wherein the method is not applied if the measured actual load pressure drops below a previously determined value.

23. A leak compensating device for a mobile crane, comprising: a lifting unit coupled to a hydraulic motor; a lowering brake valve hydraulically connected to said hydraulic motor; a hydraulic compensation chamber interposed between said hydraulic motor and said lowering brake valve; a lifting conduit providing fluid into said hydraulic compensation chamber by a pump on said mobile crane; a mechanical brake coupled to said hydraulic motor; a hydraulic pressure sensor on a load side of said hydraulic motor; a control unit operable to transfer fluid by said pump through said lifting conduit to said hydraulic compensation chamber until a predetermined pressure has been reached in said hydraulic compensation chamber.

* * * * *